US005878439A

United States Patent [19]

Waters, Jr.

[11] Patent Number: 5,878,439

[45] Date of Patent: Mar. 9, 1999

[54] GRIP MITT

[76] Inventor: John Waters, Jr., 44 Admiral St., New Haven, Conn. 06511

[21] Appl. No.: 839,877

[22] Filed: Apr. 21, 1997

Related U.S. Application Data

[63] Continuation-in-part of Ser. No. 653,061, Feb. 26, 1996, abandoned.

[51] Int. Cl.[6] ..... A41D 19/00; A47K 7/02

[52] U.S. Cl. ..... 2/161.6; 2/158; 15/227

[58] Field of Search ..... 2/158, 159, 161.6, 2/164, 169, 16, 59; 15/227

[56] References Cited

U.S. PATENT DOCUMENTS

| | | | |
|---|---|---|---|
| 133,680 | 12/1872 | Whitaker . | |
| 1,714,648 | 7/1927 | Walker . | |
| 2,283,561 | 5/1942 | Lindfelt | 2/158 |
| 2,380,633 | 7/1945 | Daiber | 2/158 |
| 2,810,131 | 10/1957 | Kogut | 2/158 |
| 2,884,644 | 9/1958 | Jefferson . | |
| 2,889,556 | 6/1959 | Mehler | 2/158 |
| 2,905,946 | 9/1959 | Goldsmith | 2/158 |
| 3,377,627 | 4/1968 | Madnick . | |
| 3,428,962 | 2/1969 | Slimovitz | 2/51 |
| 3,504,379 | 4/1970 | Glick | 2/159 |
| 3,711,889 | 1/1973 | Jennings | 2/158 X |
| 3,982,298 | 9/1976 | Ota . | |
| 4,351,067 | 9/1982 | Bartels . | |
| 4,433,439 | 2/1984 | Sidman et al. | 2/161.1 |
| 4,587,673 | 5/1986 | Boliard | 2/161.1 |
| 4,628,544 | 12/1986 | Erickson | 2/158 |

*Primary Examiner*—Gloria M. Hale
*Attorney, Agent, or Firm*—Michael I. Kroll

[57] ABSTRACT

A grip mitt (10) comprising a back piece (12) that has a forwardly claw configuration outline (14). A front piece (16) has a forwardly claw configuration outline (18) substantially corresponding to the back piece (12). An extension portion (20) is integral with and extends rearwardly from the front piece (16). A thumb piece (22) is attached into a bottom surface (24) of the front piece (16). A structure (26) is for joining the back piece (12) to the front piece (16) about the edges to form a hand covering (28) with two forward finger pockets (30) and a rear opening (32) for insertion of a hand of a person (34) therein, allowing a thumb to be received within the thumb piece (22) and two fingers to be received within each finger pocket (30) to increase the flexibility of the fingers of the hand to grasp objects more securely. The extension portion (20) will protect a forearm (36) of the person (34) from receiving burns, such as when extending the forearm (36) into a hot oven (38).

17 Claims, 7 Drawing Sheets

GRIP MITT

This Continuation-in Part and claims the filing date of Application Ser. No. 08/653,061, filed Feb. 26, 1996, now abandoned.

BACKGROUND OF THE INVENTION

1. Field of the Invention

The instant invention relates generally to hand coverings and more specifically it relates to a grip mitt. The grip mitt is claw shaped to increase the flexibility of a hand of a person wearing the mitt to grasp objects securely, will protect a forearm of the person and adjusts to fit the size of the hand.

2. Description of the Prior Art

Numerous hand coverings have been provided in prior art. For example, U.S. Pat. Nos. 133,689 to Whitaker; 1,714,648 to Walker; 2,884,644 to Jefferson; 3,377,627 to Madnick; 3,982,298 to Ota and 4,351,067 to Bartels all are illustrative of such prior art. While these units may be suitable for the particular purpose to which they address, they would not be as suitable for the purposes of the present invention as heretofore described.

WHITAKER, EDWIN V.

IMPROVEMENT IN MITTENS

U.S. Pat. No. 133,689

The invention relates to a new article of manufacture which is to be used in driving or riding horses or other animals. It consists of a mitt having the four fingers covered in pairs, so that one of the reins will pass, as usual, between the pairs, while two fingers being in each pocket or envelope, will cooperate in keeping one another warm. It also consists in a pattern which is preferably employed for cutting out the mitt.

WALKER, ELMER

MITTEN

U.S. Pat. No. 1,714,648

A mitten construction comprising a palm cover. A back cover is secured thereto to form finger and thumb pockets. A hook adapted to suspend the mitten from a belt is secured to the wrist edge of the palm cover. The free end of the hook extends outwardly from the wrist opening of the mitten and toward the palm thereof.

JEFFERSON, ORVILLE E.

PLASTIC SPONGE HOT HOLDER

U.S. Pat. No. 2,884,644

An insulated holder comprising, in combination, a mitt defining a hand receiving opening at one end, a thumb pocket and a pair of finger pockets at the opposite end of the mitt. A liner within the mitt insulates the hand from contact with the hand receiving mitt. The liner includes a thumb receiving sleeve and two finger receiving sleeves. The thumb receiving sleeve is received within the thumb pocket. The finger receiving sleeves are disposed within the finger pockets. Each one of the finger receiving sleeves includes a central longitudinal partition wall dividing the interior thereof into a pair of individual finger receiving portions.

MADNICK, HERMAN

METHOD OF MAKING A CURVED PALM HAND COVERING

U.S. Pat. No. 3,377,627

Method of making a sewn hand covering having a curvature substantially corresponding to that of the hand at rest by forming the back portion thereof longer than the front portion. Shirring the edges of the back portion along a portion of the sides thereof to make its length correspond with that of the front portion. Then joining the front and back portions by stitching them together along their peripheral edges.

OTA, TUNEZO

MITT TYPE SHOE CLEANER

U.S. Pat. No. 3,982,298

A mitt type shoe cleaner having first and second brushes secured to non-expandable flexible thumb and finger receiving sections, respectively. The sections are secured together by a central section made from elastic material, so that the mitt may accommodate various sizes of hands.

BARTELS, FRANKLIN D.

WORK GLOVES WITH ATTACHMENT MECHANISM

U.S. Pat. No. 4,351,067

A pair of work gloves are provided with a special attachment mechanism which permits them to be removably attached to a workman's belt or releasably connected to one another. A strip is connected to the cuff of each of the gloves. A pair of mating hook weave connecting surfaces are secured to opposite ends of the strip. The strip may be encircled around the workman's belt and the hook weave connecting surfaces pressed together, so that the glove will be removably attached to the belt. Each strip further has a third hook weave connecting surface secured thereto. The third surfaces of a pair of similar gloves are adapted to mate with each other to removably connect the gloves together. The mating hook weave connecting surfaces are dimensioned, so that the gloves can be disconnected from one another and the hook weave surfaces that hold each of the strips in a loop configuration will not become disconnected.

SUMMARY OF THE INVENTION

A primary object of the present invention is to provide a grip mitt that will overcome the shortcomings of the prior art devices.

Another object is to provide a grip mitt that is claw shaped to increase the flexibility of the fingers of a hand of a person wearing the mitt to grasp objects more securely.

An additional object is to provide a grip mitt that contains an extension portion, which will protect the forearm of the person wearing the mitt from receiving burns, such as when extending the forearm into a hot oven.

A still further object is to provide a grip mitt that utilizes VELCRO straps on the extended front piece to assist in transporting the mitt on an apron belt.

A further object is to provide a grip mitt that is simple and easy to use.

A still further object is to provide a grip mitt that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

Various other objects, features and attendant advantages of the present invention will become more fully appreciated as the same becomes better understood when considered in conjunction with the accompanying drawings, in which like reference characters designate the same or similar parts throughout the several views, and wherein.

Similar reference characters denote corresponding features consistently throughout the attached drawings.

DETAILED DESCRIPTION OF THE PREFERRED EMBODIMENTS

Figure 1:
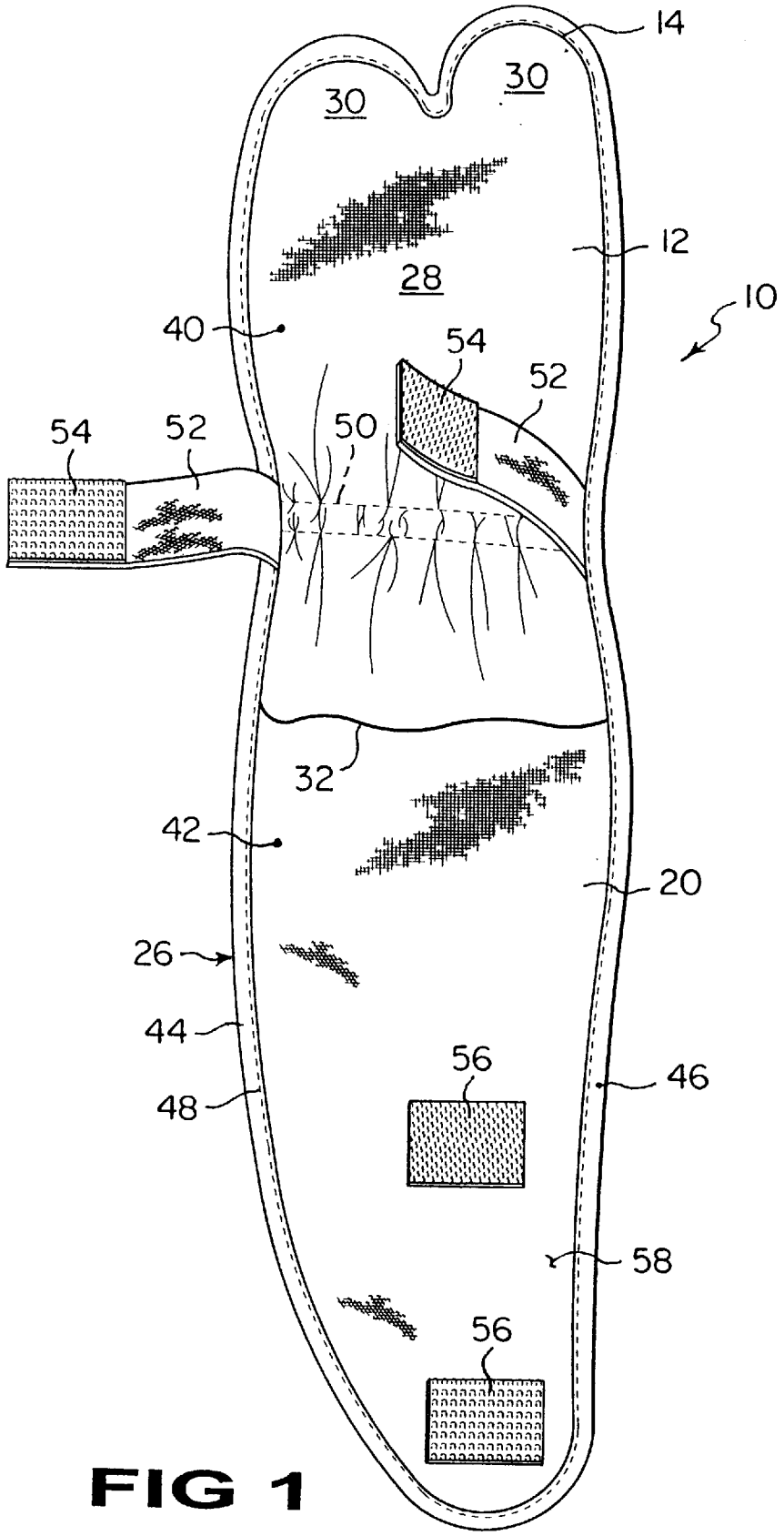
FIG. 1 is a top plan view of one mitt of a first embodiment adapted for the right hand.

Turning now descriptively to the drawings, in which similar reference characters denote similar elements throughout the several views, FIGS. 1 through 5 illustrate a grip mitt 10 of the present invention. With regard to the reference numerals used, the following numbering is used throughout the various drawing figures.

10 grip mitt

12 back piece of 10

14 claw configuration outline on 12

16 front piece of 10

18 claw configuration outline on 16

20 extension portion of 10

22 thumb piece of 10

24 bottom surface of 16 and 20

26 joining structure of 10

28 hand covering of 10

30 finger pocket of 28

32 rear opening in 28

34 person

36 forearm of 34

38 hot oven

40 padded heat insulated fire retardant fabric material for 12

42 heavy duty padded heat insulated fire retardant fabric material for 16, 20 and 22

44 piping border for 26

46 fire retardant fabric for 44

48 sewing thread in 44

50 elastic strip in 12

52 strap member of 10

54 VELCRO fabric fastener pad on 52

56 VELCRO fabric fastener patch on 58

58 top surface of 20

60 apron belt

62 first VELCRO fabric fastener tab on 24

64 second VELCRO fabric fastener tab on 24

The grip mitt 10 comprises a back piece 12 that has a forwardly claw configuration outline 14. A front piece 16 has a forwardly claw configuration outline 18 substantially corresponding to the back piece 12. An extension portion 20 is integral with and extends rearwardly from the front piece 16. A thumb piece 22 is attached into a bottom surface 24 of the front piece 16. A structure 26 is for joining the back piece 12 to the front piece 16 about the edges to form a hand covering 28 with two forward finger pockets 30 and a rear opening 32 for insertion of a hand of a person 34 therein, allowing a thumb to be received within the thumb piece 22 and two fingers to be received within each finger pocket 30 to increase the flexibility of the fingers of the hand to grasp objects more securely. The extension portion 20 will protect a forearm 36 of the person 34 from receiving burns, such as when extending the forearm 36 into a hot oven 38.

The back piece 12 is fabricated out of a padded heat insulated fire retardant fabric material 40. The front piece 16 with the extension portion 20 and the thumb piece 22 are all fabricated out of a heavy duty padded heat insulated fire retardant fabric material 42.

The joining structure 26 is a piping border 44 constructed from a fire retardant fabric 46 and sewn about the edges of the back piece 12 and the front piece 16 with thread 48. An elastic strip 50 is integral within the back piece 12 adjacent the rear opening 32, so as to provide a snug fit for the hand when inserted into the hand covering 28.

A pair of strap members 52 are provided. Each strap member 52 is attached at one end at the edge of the back piece 12 to overlap each other. a pair of VELCRO fabric fastener pads 54 are also provided. Each pad 54 is affixed to a free end of one strap member 52. When the strap members 52 overlap, the fastener pads 54 will engage with each other to adjust the hand covering 28 to the width of the hand. A pair of VELCRO fabric fastener patches 56 are spaced apart and attached to a top surface 58 at a free end of the extension portion 20. When the free end of the extension portion 20 is bent over, the fastener patches 56 will engage with each other to form a loop, to be carried on an apron belt 60 on the person 34 when not in use (see FIG. 5).

A first a VELCRO fabric fastener tab 62 is affixed to the bottom surface 24 of the extension portion 20. A mating second VELCRO fabric fastener tab 64 affixed to the bottom surface 24 of another extension portion 20 of a second grip mitt 10 can engage with the first VELCRO fabric fastener tab 62, to allow the pair of grip mitts 10 to hang on a wall with the aid of a hook and to be carried on the apron belt 60 on the person 34 when not in use. The first grip mitt 10 is constructed for a right hand of the person 34, while the second grip mitt 10 is constructed for a left hand of a person 34. The first VELCRO fabric fastener tab 62 and the second VELCRO fabric fastener tab 64 are hook and loop material types.

Figure 1A:
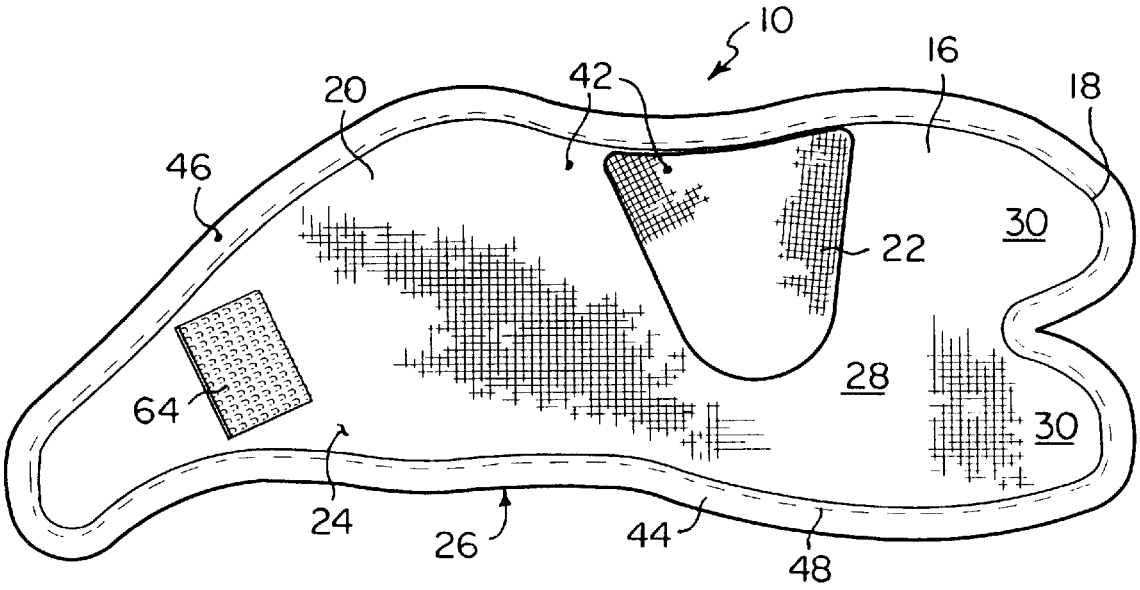
FIG. 1A is a bottom plan view of a pair of mitts of a second embodiment adapted for the right and left hands.
Figure 1A:
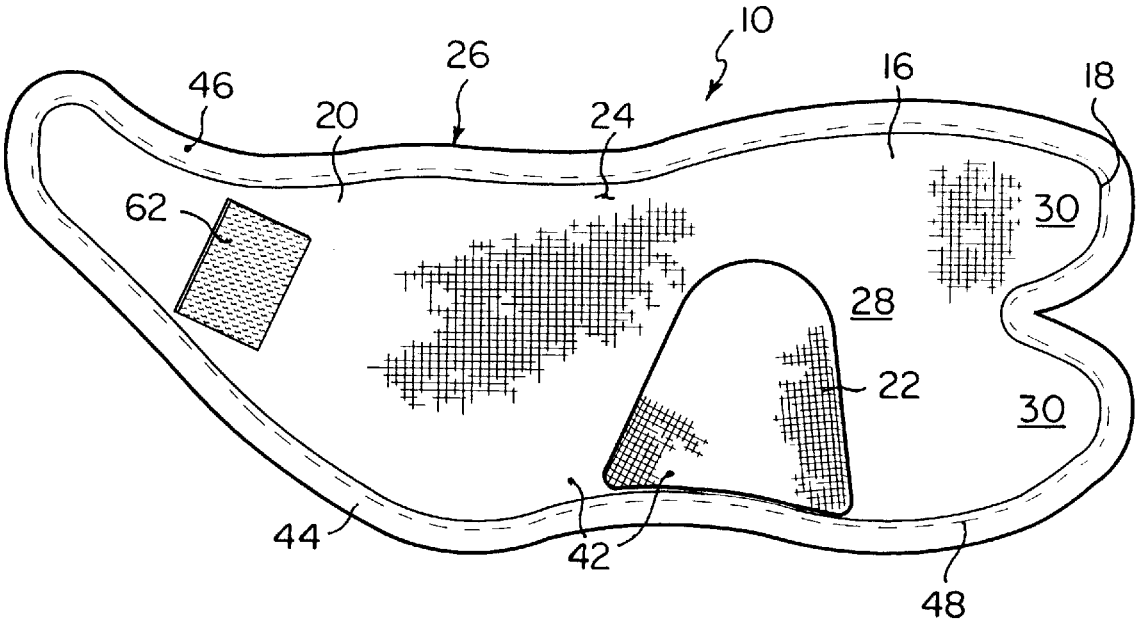
Figure 1B:
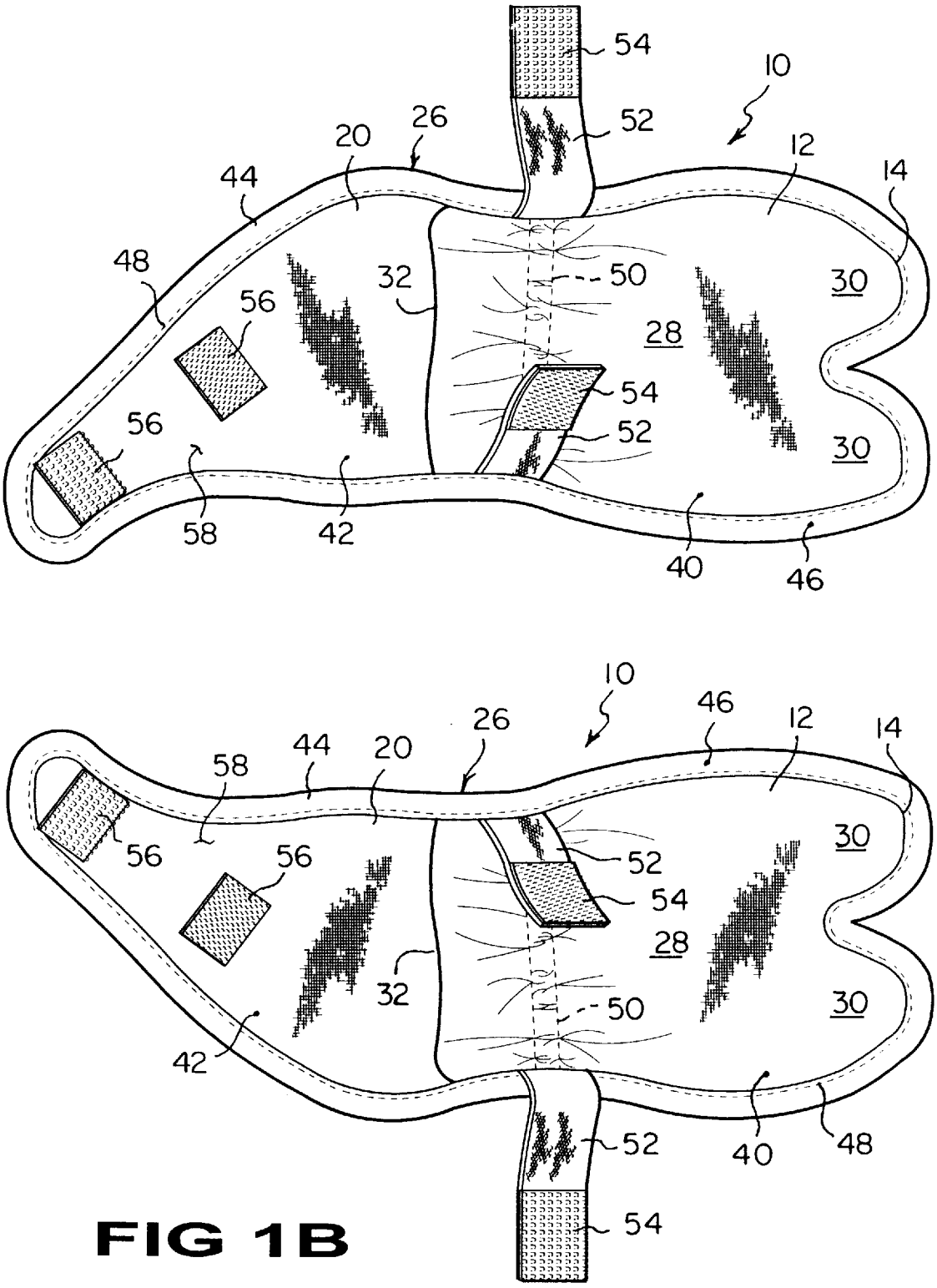
FIG. 1B is a top plan view of the pair of mitts of the second embodiment.
Figure 2:
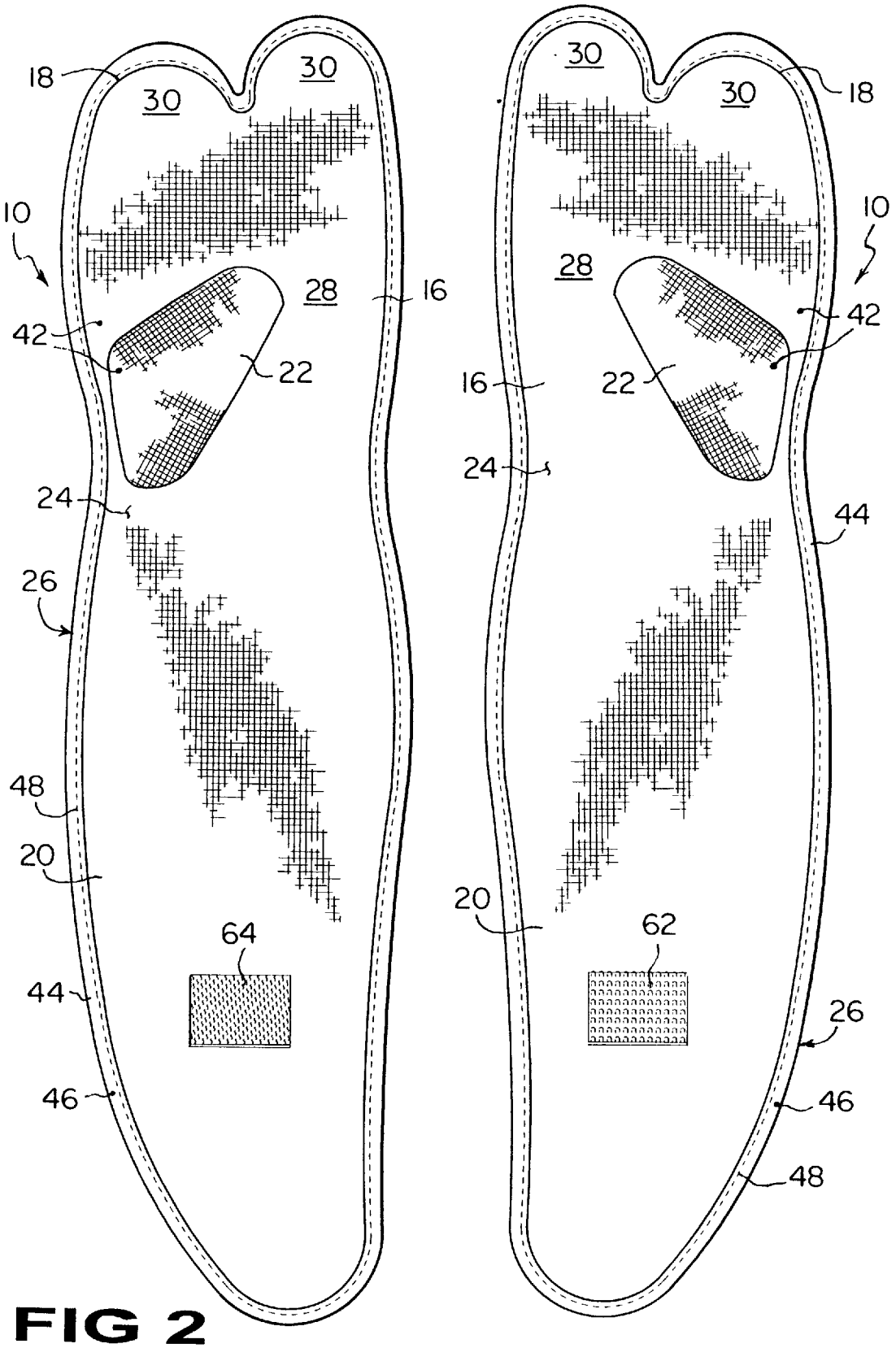
FIG. 2 is a bottom plan view of a pair of mitts of the first embodiment adapted for the right and left hands.
Figure 3:
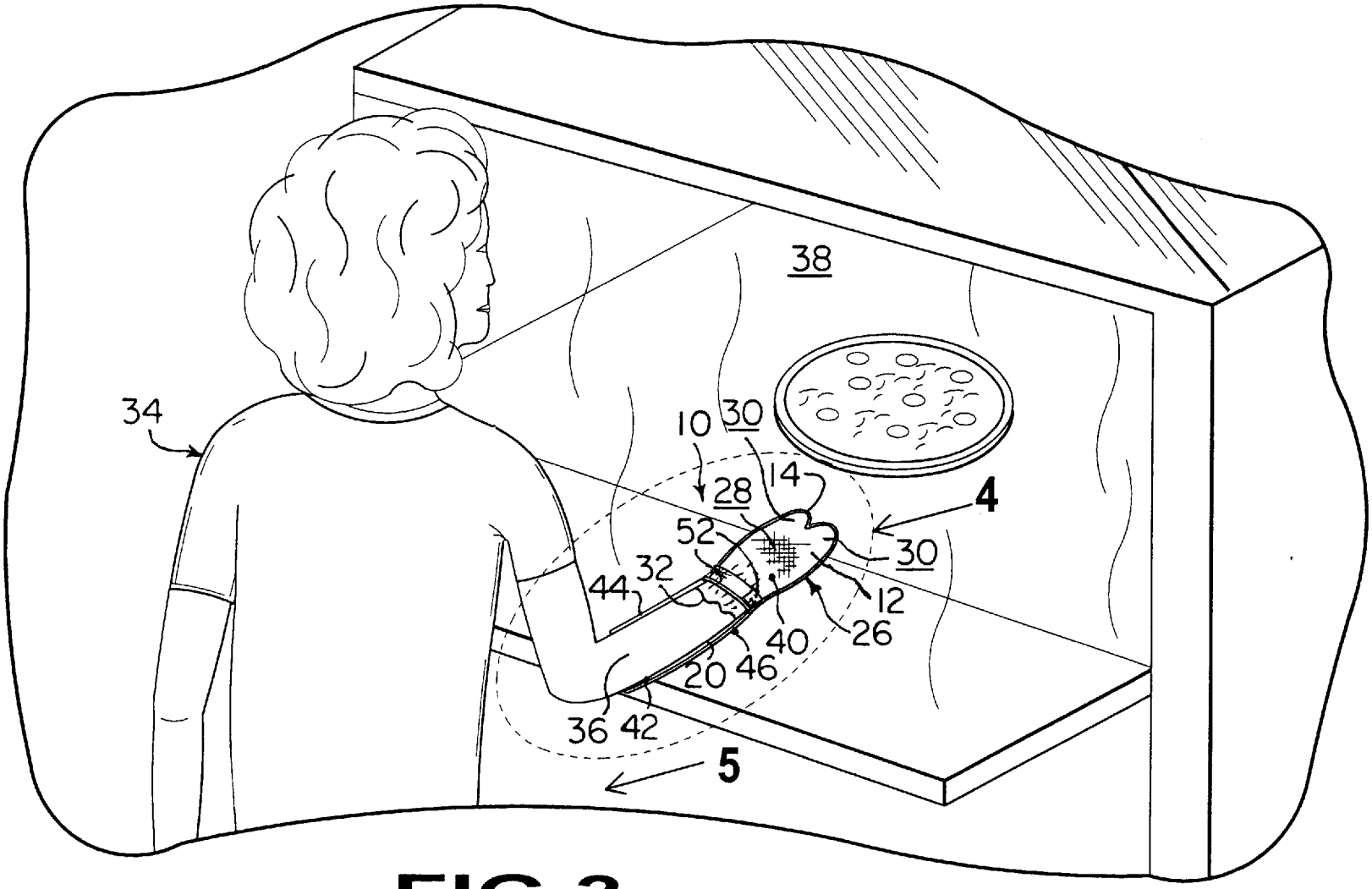
FIG. 3 is a perspective view, showing a person wearing the mitt of the first embodiment on the right hand at a hot oven.
Figure 4:
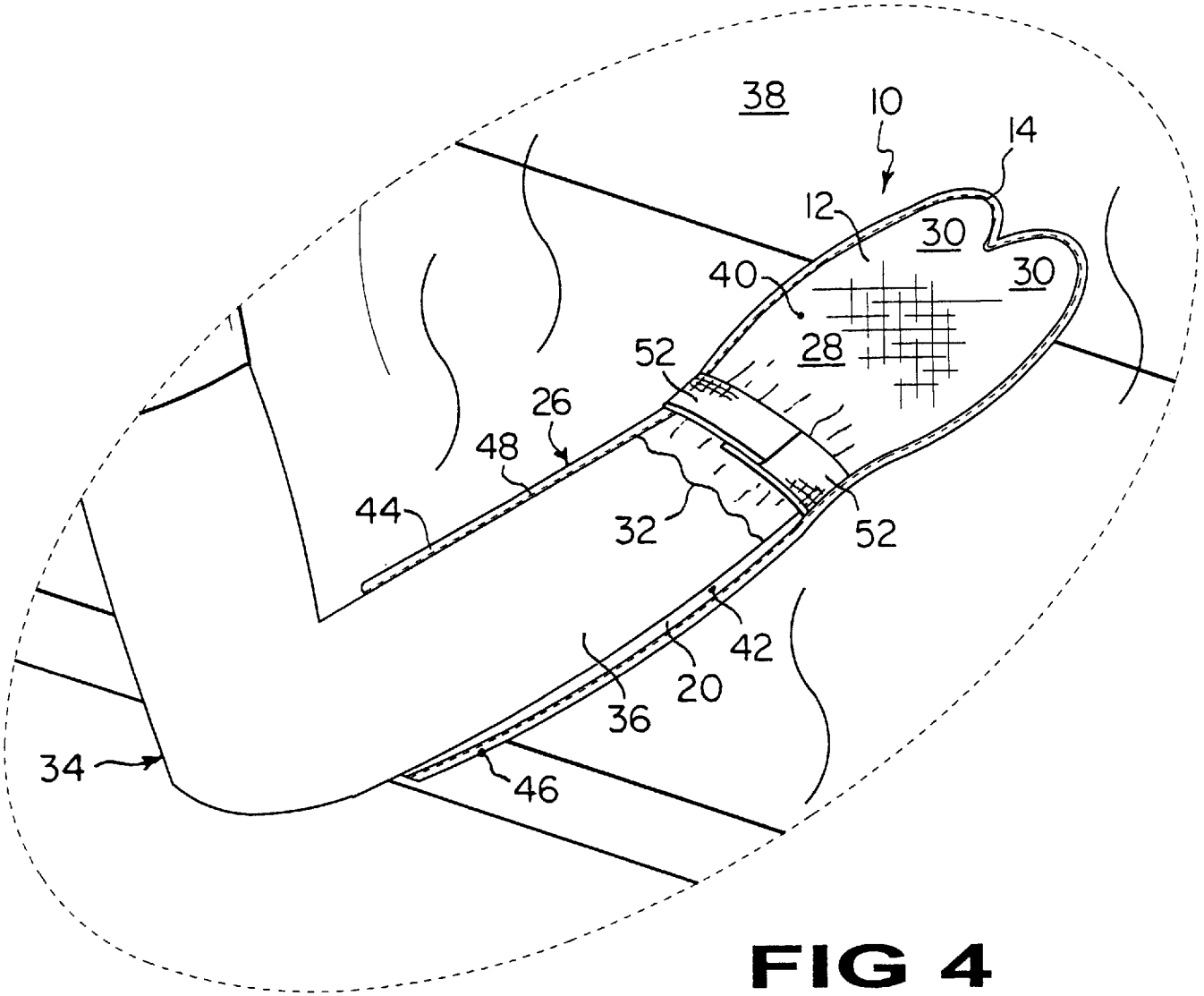
FIG. 4 is an enlarged perspective view of an area indicated by arrow 4 in FIG. 3.
Figure 5:
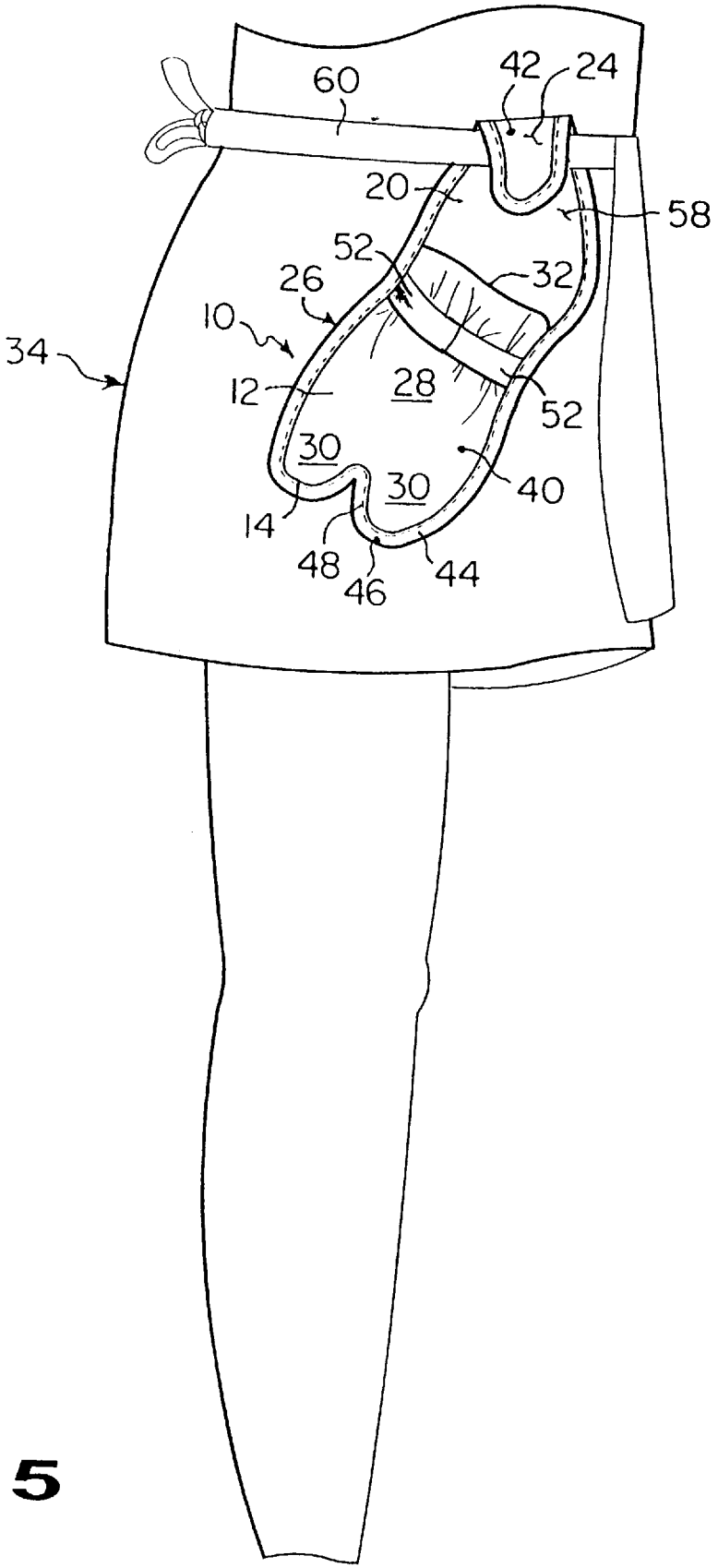
FIG. 5 is a side view of the person taken in the direction of arrow 5 in FIG. 3, showing the mitt carried on an apron belt.

The extension portion 20, as shown in FIGS. 1, 2, 3 and 4, is generally straight and is about the same length as the front piece 16. the extension portion 20 will cover and protect the bottom surface of the forearm 36 of the person 34 wearing the grip mitt 10. The extension 20, as shown in FIGS. 1A and 1B, is generally curved and is about the same length as the front piece 16. The extension portion 20 will cover and protect most of the bottom surface of the forearm 36 of the person 34 wearing the grip mitt 10.

It will be understood that each of the elements described above, or two or more together may also find a useful application in other types of methods differing from the type described above.

While certain novel features of this invention have been shown and described are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A grip mitt comprising:

a) a back piece having a forwardly claw configuration outline;

b) a front piece having a forwardly claw configuration outline substantially corresponding to said back piece;

c) an extension portion integral with and extending rearwardly from said front piece;

d) a thumb piece attached into a bottom surface of said front piece;

e) means for joining said back piece to said front piece about edges thereof to form a hand covering with two forward finger pockets and a rear opening for insertion of a hand of a person therein, allowing a thumb to be received within said thumb piece and two fingers to be received within each said finger pocket to increase the flexibility of the fingers of a wearer's hand to grasp objects more securedly, while said extension portion will protect a forearm of the person from receiving burns, such as when extending a wearer's forearm into a hot oven; and f) a pair of hook and loop fastener patches, spaced apart and attached to a top surface at a free end of said extension portion, so that when the free end of said extension portion is bent over said fastener patches will engage with each other to form a loop, to be carried on an apron belt on the person when not in use.

2. A grip mitt as recited in claim 1, wherein said back piece is fabricated out of a padded heat insulated fire retardant fabric material.

3. A grip mitt as recited in claim 1, wherein said front piece with said extension portion and said thumb piece are all fabricated out of a heavy duty padded heat insulated fire retardant fabric material.

4. A grip mitt as recited in claim 1, wherein said joining means is a piping border constructed from a fire retardant fabric and sewn about the edges of said back piece and said front piece.

5. A grip mitt as recited in claim 1, further including an elastic strip integral within said back piece adjacent said rear opening, so as to provide a snug fit for the hand when inserted into said hand covering.

6. A grip mitt as recited in claim 1, further including:

a) a pair of strap members, in which each said strap member is attached at one end at the edge of said back piece to overlap each other; and b) a pair of hook and loop fabric fastener pads, in which each said pad is affixed to a free end of one said strap member, so that when said strap members overlap said fastener pads will engage with each other to adjust said hand covering to the width of the hand.

7. A grip mitt as recited in claim 1, further including a first hook and loop fabric fastener tab affixed to the bottom surface of said extension portion, so that a mating second hook and loop fabric fastener tab affixed to the bottom surface of another extension portion of a second grip mitt can engage with said first hook and loop fabric fastener tab, to allow said pair of grip mitts to hang on a wall with the aid of a hook and to be carried on an apron belt on the person when not in use.

8. A grip mitt as recited in claim 7, wherein said first grip mitt is constructed for a right hand of the person, while said second grip mitt is constructed for a left hand of a person.

9. A grip mitt as recited in claim 1, wherein said extension portion is generally straight and is about the same length as said front piece, whereby said extension portion will cover and protect the bottom surface of the forearm of the person wearing said grip mitt.

10. A grip mitt as recited in claim 1, wherein said extension portion is generally curved and is about the same length as said front piece, whereby said extension portion will cover and protect most of the bottom surface of the forearm of the person wearing said grip mitt.

11. A grip mitt as recited in claim 2, wherein said joining means is a piping border constructed from a fire retardant fabric and sewn about the edges of said back piece and said front piece.

12. A grip mitt as recited in claim 11, further including an elastic strip integral within said back piece adjacent said rear opening, so as to provide a snug fit for the hand when inserted into said hand covering.

13. A grip mitt as recited in claim 12, further including:

a) a pair of strap members, in which each said strap member is attached at one end at the edge of said back piece to overlap each other; and b) a pair of hook and loop fabric fastener pads, in which each said pad is affixed to a free end of one said strap member, so that when said strap members overlap said fastener pads will engage with each other to adjust said hand-covering to the width of the hand.

14. A grip mitt as recited in claim 13, further including a first hook and loop fabric fastener tab affixed to the bottom surface of said extension portion, so that a mating second hook and loop fabric fastener tab affixed to the bottom surface of another extension portion of a second grip mitt can engage with said first hook and loop fabric fastener tab, to allow said pair of grip mitts to hang on a wall with the aid of a hook and to be carried on an apron belt on the person when not in use.

15. A grip mitt as recited in claim 14, wherein said first grip mitt is constructed for a right hand of the person, while said second grip mitt is constructed for a left hand of a person.

16. A grip mitt as recited in claim 15, wherein said extension portion is generally straight and is about the same length as said front piece, whereby said extension portion will cover and protect the bottom surface of the forearm of the person wearing said grip mitt.

17. A grip mitt as recited in claim 15, wherein said extension portion is generally curved and is about the same length as said front piece, whereby said extension portion will cover and protect most of the bottom surface of the forearm of the person wearing said grip mitt.

* * * * *